United States Patent [19]

Strauss

[11] Patent Number: 4,541,534

[45] Date of Patent: Sep. 17, 1985

[54] DISPLAY RACK FOR SUNGLASSES OR SIMILAR ARTICLES

[75] Inventor: Helmut Strauss, Englewood, N.J.

[73] Assignee: Hudson Universal Ltd., Englewood, N.J.

[21] Appl. No.: 652,652

[22] Filed: Sep. 20, 1984

[51] Int. Cl.[4] ..... A47F 7/02

[52] U.S. Cl. ..... 211/13; 211/133; 211/194; 248/DIG. 2

[58] Field of Search ..... 248/DIG. 2; 211/13, 211/194, 188, 163, 133, 131; 206/5 R, 503, 561, 564

[56] References Cited

U.S. PATENT DOCUMENTS

| | | | |
|---|---|---|---|
| 2,936,897 | 5/1960 | Bloch | 211/13 |
| 2,953,257 | 9/1960 | McNeill | 211/131 |
| 3,357,568 | 12/1967 | Leblanc et al. | 248/DIG. 2 X |
| 3,955,681 | 5/1976 | DeZinno | 248/DIG. 2 X |
| 4,030,608 | 6/1977 | Howard | 211/131 |
| 4,157,760 | 6/1979 | Wilson | 248/DIG. 2 X |

*Primary Examiner*—Robert W. Gibson, Jr.
*Attorney, Agent, or Firm*—Arthur L. Plevy

[57] ABSTRACT

A display rack for sunglasses includes a series of individual compartments oriented in the vertical plane and arranged in a stacked array. The display rack includes a plurality of vertical wall members with at least three central members oriented to form a "Z" like cross sectional configuration. At each compartment location, there are secured to the vertical wall members first and second planar members with each planar member having a first triangular shaped arm extending from a common base and separated from a second arm by a triangular cutout. The cutouts of each planar member are inserted into respective sides of said "Z" configuration to form first and second shelves at said compartment location with each shelf capable of accommodating a pair of glasses.

8 Claims, 4 Drawing Figures

DISPLAY RACK FOR SUNGLASSES OR SIMILAR ARTICLES

BACKGROUND OF THE INVENTION

This invention relates to a display rack in general and more particularly to a display rack particularly adapted for use in promoting the sale of sunglasses or the like.

Essentially, the prior art is replete with a number of rack like devices which are used for displaying sunglasses or similar items to promote the sale of the same. In regard to such devices many of these devices consist of a rotary rack. Such a rack can be rotated by a consumer and can hold a large number of glasses. In any event, in order to accommodate such a rack, the merchant must provide ample space to allow the consumer to rotate the rack and so on.

Examples of such devices may be had by reference to U.S. Pat. No. 4,157,760 entitled EYEGLASS FRAME DISPLAY DEVICE issued on June 12, 1979 to S. R. Wilson. Another example of such a device may be had by referring to U.S. Pat. No. 2,936,897 entitled ROTARY DISPLAY RACK FOR SUNGLASSES OR THE LIKE issued on May 17, 1960 to J. Bloch.

In general such devices are extremely difficult to manufacture, are very expensive and are relatively bulky. Apart from the above problems, the device must possess a mechanism which will enable a pair of sunglasses to be held in place within the rack so that the consumer can see the sunglasses and can easily remove the same from the rack and replace the same as desired. As such, the support mechanisms for such glasses in regard to existing types of racks are relatively complicated and difficult to use. Thus a consumer will remove a pair of glasses and then replace the glasses on the rack in an improper manner. This results in a great waste of time and effort, and merchants have experienced a great deal of difficulty in the use and placement of the racks.

It is therefore an object of the present invention to provide an improved display rack which rack is simple to fabricate and which provides the consumer with an entire view of a pair of sunglasses which view includes the front of the glasses as well as the ear pieces. The rack is capable of supporting a large number of glasses in a minimum amount of space and enables the consumer to view the glasses in an efficient manner.

The display rack is easy to construct as employing symmetrical members and provides a reliable and positive support for glasses which are being accommodated by the rack.

BRIEF DESCRIPTION OF THE PREFERRED EMBODIMENT

A display rack for sunglasses or similar articles, said rack of the type including a series of individual compartments oriented in the vertical plane in a stacked array, comprising a plurality of vertical wall members extending in the vertical plane with at least three central vertical wall members oriented to form a "Z" like cross sectional configuration, first and second planar members secured to said vertical wall members at each compartment location and directed in a generally horizontal plane, with each planar member being of an identical configuration, each having a first triangular shaped arm extending from a common base and separated from a second arm extending from said common base with said second arm separated from said first arm by a triangular cutout of the same configuration as said first arm, with each cutout of each planar member inserted into one side of said "Z" formed by said vertical wall members to enable one pair of glasses to be retained by each planar member with the temple portions of said glasses extending along the respective first and second arms of each planar member.

DETAILED DESCRIPTION OF THE FIGURES

Figure 1:
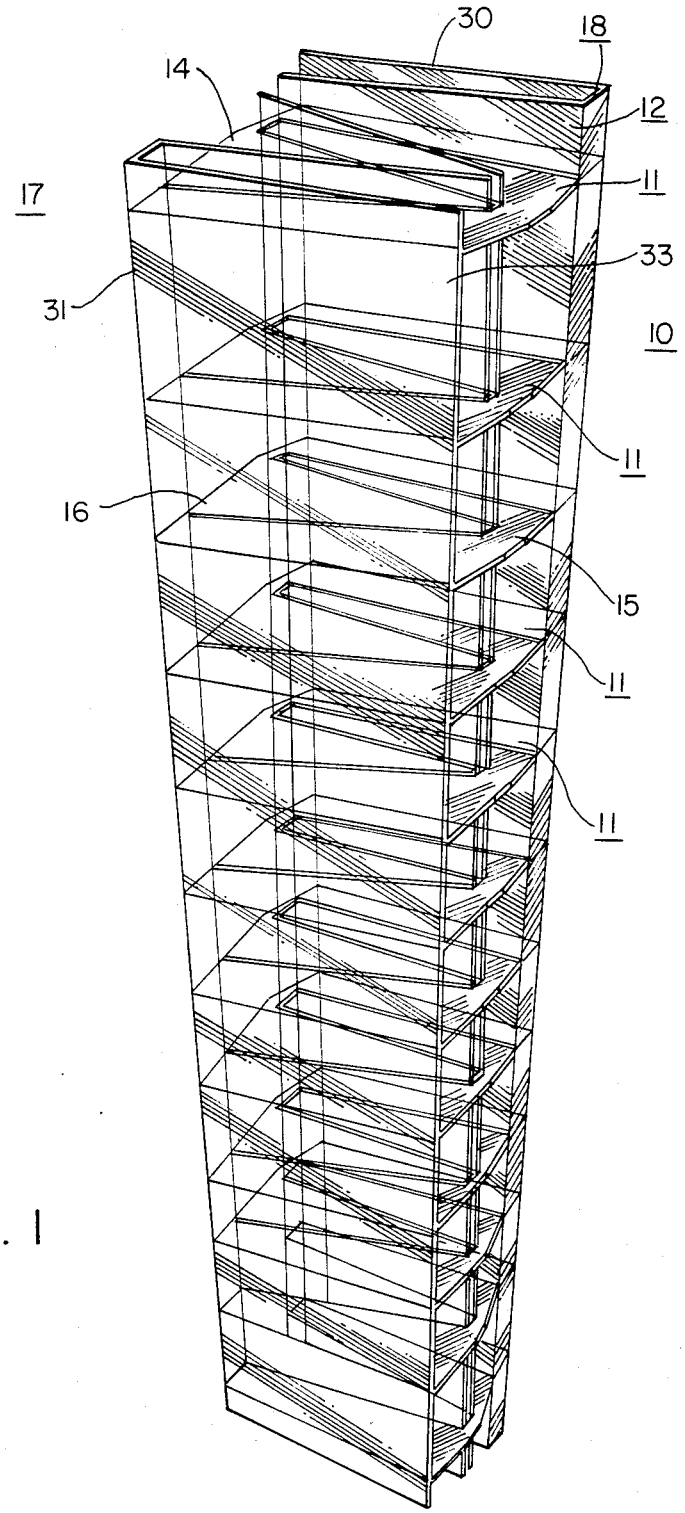
FIG. 1 is a perspective plan view of a display rack according to this invention.

FIG. 1 shows a perspective view of a display rack 10 according to this invention.

Essentially, the display rack 10 consists of a series of compartments such as 11 which compartments allow a pair of sunglasses to be inserted in a first end 12 and a second end 14. Thus each compartment can accommodate two pairs of glasses at relatively the same level which is more clearly shown in FIG. 2.

Each compartment consists of identical plates as plates 15 and 16 which plates are secured between corresponding vertical upstanding members 17 and 18. As will be explained, the members 17 and 18 are angled frame members for supporting the plates 15 and 16.

Figure 2:
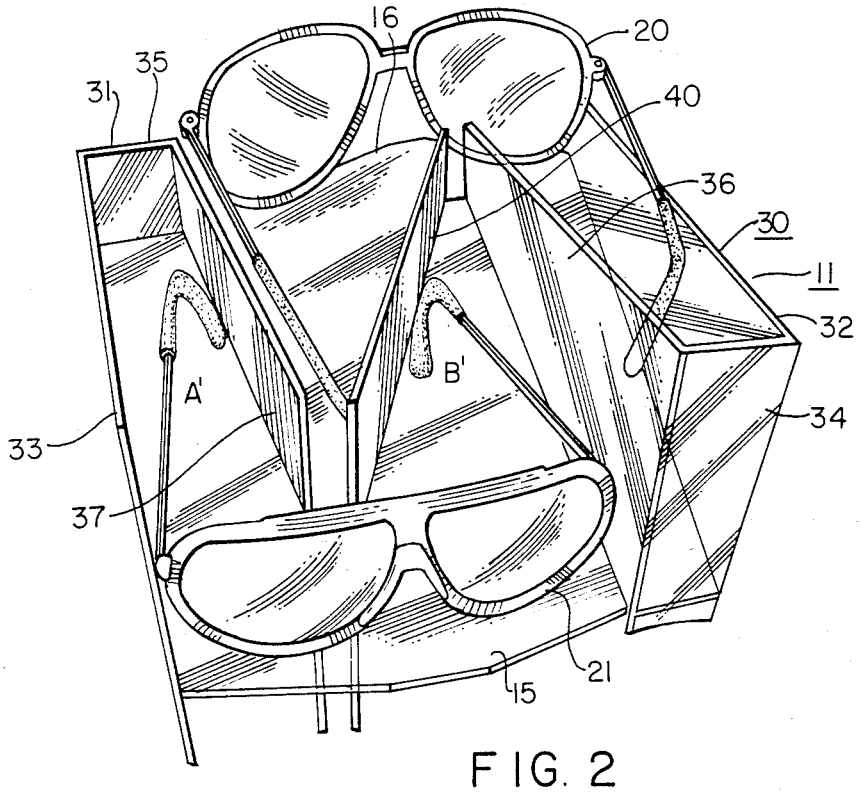
FIG. 2 is a perspective view of an individual compartment of the display rack.

In order to gain a clearer understanding of the present invention, reference is made to FIG. 2.

Figure 3:
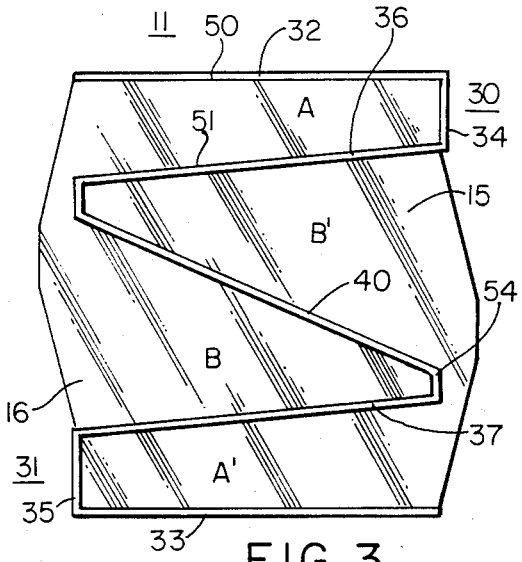
FIG. 3 is a top plan view of a typical compartment as included in the display rack.

In FIG. 2 there is shown a single compartment as compartment 11 in a perspective view. The plate 15 and plate 16 are depicted and are further shown in detail in FIG. 3. Each plate is positioned between the vertical support members so that it is at an angle with respect to the horizontal plane as shown in the side view of FIG. 4. As shown in FIG. 3, each plate consists of a first arm A which depends from a base section and has a second arm B also depending from the base section. Thus each plate has a central cutout between arms A and B which cutout is of the same configuration as arm B of plate 16 or arm B′ of plate 15.

Figure 4:
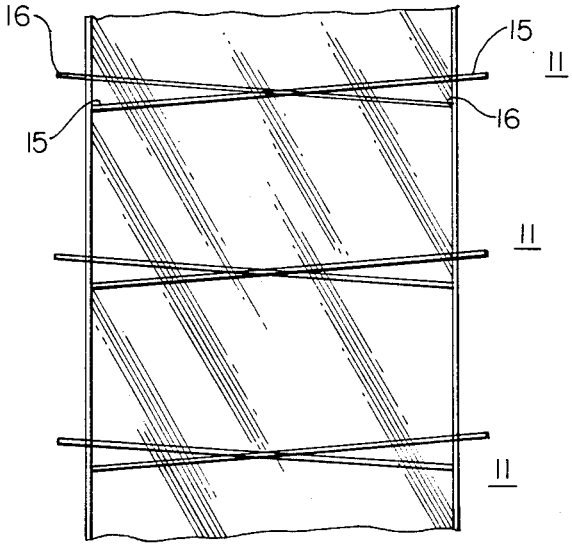
FIG. 4 is a side view showing individual compartments consisting of symmetrical plates.

As can be seen from FIG. 3, arm A appears as a quadrilateral where essentially the top and bottom sides as 50 and 51 are directed at a slight angle with respect to one another. Arm B is essentially triangular in shape with a flat top portion 54. The opening between arms A and B is of the configuration of arm B to allow the two units to be inserted between the vertical support members as shown. The angular inner sides of the arms A and B as well as the slight angle of the outer sides of arms A and B provide for great support between these arms and the vertical extending members to give greater rigidity to the completed assembly. Thus the plates are inserted between the vertical walls as shown in FIG. 3, and as indicated above, they are placed in a corresponding angle as shown in FIG. 4.

In this manner the glasses as 20 and 21 rest upon the surface of the planar members as 15 and 17 and are retained therein in a completely stable position. As one can perceive from FIG. 1, the display apparatus consists of a plurality of stacked compartments 11, each of which is capable of accommodating two pairs of glasses. As will be explained, the entire structure is made from a clear plastic, and hence the consumer can see the entire sunglasses assembly clearly. This aspect is not available with prior art displays because in such displays the consumer can see the spectacle portion of the glasses but cannot see the ear pieces or temple pieces without removing the glasses from the display.

Referring back to FIG. 2, the construction of the display is clearly shown. The plates 15 and 16 as shown in FIG. 3 are mirror images of each other and may be formed by the same process. The plates are inserted between the vertical support members such as members 30 and 31. These members are also symmetrical and extend vertically from the top to the bottom of the rack.

As seen in FIG. 1, the right side member 30 consists of a first vertical wall 32 which extends from the top to the bottom of the rack while the vertical member 31 has a corresponding vertical wall 33. The walls as 32 and 33 each have a front portion as 34 and 35 which is a relatively flat vertical section extending from the top and bottom of the rack. Vertical walls as 36 and 37 are disposed at an angle with respect to walls 32 and 33 with another extending vertical planar member 40 also disposed at an angle between plates 15 and 16.

As above indicated, the plates 15 and 16 have corresponding slots to allow them to interface with the walls and to be supported by the walls to form the individual compartments. As can be seen from FIG. 3, the walls 36, 40 and 37 form an inverted "Z" where the sides of the inverted "Z" coact with the corresponding sides of the triangular plate portions B and B′ of plates 15 and 16 to thus provide support and a large surface area for securing the plates to the vertical members 36, 40, and 37. It is of course seen from FIG. 3 that the walls 36, 37 and 40 form an inverted "Z" from the top view. In any event, if the unit were inverted, the walls would appear as a normal "Z" like configuration.

Plates 15 and 16 are then secured to the corresponding walls as walls 32, 24, 36, 40, 37, 35 and 33 by means of a suitable glue or other bond with the plates being canted as shown in FIG. 4 at a suitable angle so that each pair of sunglasses can rest within the thus formed compartment as shown. As shown in FIGS. 2 and 3, the sloping wall sections such as walls 37, 40 and 36 function to open the temples of the sunglasses as the glasses are inserted back into the compartment by the consumer. The resultant display provides an extremely attractive rack for displaying glasses while being simple to construct and fabricate.

As seen from the above, the plates 15 and 16 are and are therefore formed by the same cutting processes as plate 15 is a mirror image of plate 16 and vice versa. These plates are then glued to the vertical supporting walls at predetermined intervals so that two pairs of glasses can be accommodated at each compartment level. The central "Z" formed by the side walls as walls 36, 40, and 37 aid in retaining the sunglasses in an open position as the walls will contact the temples of the spectacles when the consumer places the spectacles back into the rack.

Since the structure is made from a clear or transparent plastic, the consumer can now visualize the spectacles in their entirety and can therefore select a pair of glasses from either end of the device. The rack can be thus positioned as shown in FIG. 1 against the wall of a store, and it does not require any rotating assembly but can accommodate the same number of sunglasses as accommodated by prior rotary display racks.

For example, as shown in FIG. 1, there are approximately 12 compartments depicted in the rack which rack can therefore accommodate 24 pairs of sunglasses. The entire height of such a rack is less than 3 feet, while the width of the rack is a little greater than the width of a typical pair of glasses as can be seen from FIG. 2.

The fact that the shelves 15 and 16 are angled as shown in FIG. 4 enable the positive support of the glasses when placed on the shelves and hence prevent dislodging of the glasses if the display is accidently bumped into by a customer. This is another important feature of the display rack which is not available in prior art devices.

I claim:

1. A display rack for sunglasses or similar articles, said rack of the type including a series of individual compartments oriented in the vertical plane in a stacked array, comprising;

a plurality of vertical wall members extending in the vertical plane with at least three central vertical wall members oriented to form a "Z" like cross sectional configuration, first and second planar members secured to said vertical wall members at each compartment location and directed in a generally horizontal plane, with each planar member being of an identical configuration, each having a first triangular shaped arm extending from a common base and separated from a second arm extending from said common base with said second arm separated from said first arm by a triangular cutout of the same configuration as said first arm, with each cutout of each planar member inserted on to one side of said "Z" formed by said vertical wall members to enable one pair of glasses to be retained by each planar member with the temple portions of said glasses extending along the respective first and second arms of each planar member.

2. The display rack according to claim 1, wherein said first planar member is positioned at an angle with respect to the horizontal plane to allow said temples of said accommodated eyeglasses to tilt downwardly with respect to said front spectacle section.

3. The display rack according to claim 1, wherein said second arm is a quadrilateral.

4. The display rack according to claim 1, wherein said vertical wall members and said planar members are all fabricated from a clear plastic.

5. The display rack according to claim 1, further including outer vertical walls secured to the sides of said first arm of said first and second planar members opposite the side coacting with said "Z" like configuration.

6. The display rack according to claim 1, wherein said common base portion of each planar member extends outwardly from said vertical walls for supporting the front spectacle portion of an accommodated pair of glasses.

7. The display rack according to claim 1, wherein the top vertex of said triangular shaped arm is flattened.

8. The display rack according to claim 1, wherein said planar members are secured to said vertical support members by means of a suitable adhesive.

* * * * *